United States Patent [19]

Whelan

[11] Patent Number: 4,720,660

[45] Date of Patent: Jan. 19, 1988

[54] PROJECTOR LAMP

[75] Inventor: Dennis P. Whelan, Queniborough, England

[73] Assignee: Thorn EMI plc, London, England

[21] Appl. No.: 824,373

[22] Filed: Jan. 23, 1986

[30] Foreign Application Priority Data

Jan. 28, 1985 [GB] United Kingdom ..... 8502034

[51] Int. Cl.[4] ..... H01J 17/14

[52] U.S. Cl. ..... 315/344; 315/347; 313/12; 313/153; 313/156; 313/161; 313/17; 362/265; 362/296

[58] Field of Search ..... 315/344, 347; 362/265, 362/232, 310, 296; 313/17, 12, 46, 153, 156–157, 160, 161

[56] References Cited

U.S. PATENT DOCUMENTS

| | | | |
|---|---|---|---|
| 2,767,243 | 10/1956 | Yaeger | 315/347 X |
| 3,562,583 | 2/1971 | Zollweg et al. | 315/344 |
| 3,867,660 | 2/1975 | Fohl | 313/12 |
| 3,883,766 | 5/1975 | Fohl | 313/220 |
| 4,001,626 | 1/1977 | Drop et al. | 313/229 |
| 4,053,809 | 10/1977 | Fridrich et al. | 313/161 X |

FOREIGN PATENT DOCUMENTS

| | | | |
|---|---|---|---|
| 951,859 | 3/1964 | United Kingdom | 315/344 X |

OTHER PUBLICATIONS

"Lamps and Lighting", Ed. Henderson & Marsden 2nd Ed. pp. 274–276.

*Primary Examiner*—David K. Moore
*Assistant Examiner*—Mark R. Powell
*Attorney, Agent, or Firm*—Fleit, Jacobson, Cohn & Price

[57] ABSTRACT

A projector lamp comprising a single ended metal halide discharge lamp in a generally spherical reflector has been found to exhibit turbulence when running. The resulting fluctuation of light especially when used in conjunction with the reflector to concentrate the light for studio or theatre applications provides an apparent movement which is extremely disturbing to the eye. It has been found the turbulent movement of gas around the electrodes in the lamp envelope can be regularised by the application of a magnetic field to the envelope. The turbulence is sensitive to conditions within the discharge arc tube and the strength and position of the magnetic field has to be variable to cater for this. The magnetic field is conveniently applied by an electromagnet using lamp current.

10 Claims, 6 Drawing Figures

PROJECTOR LAMP

Figure 1:
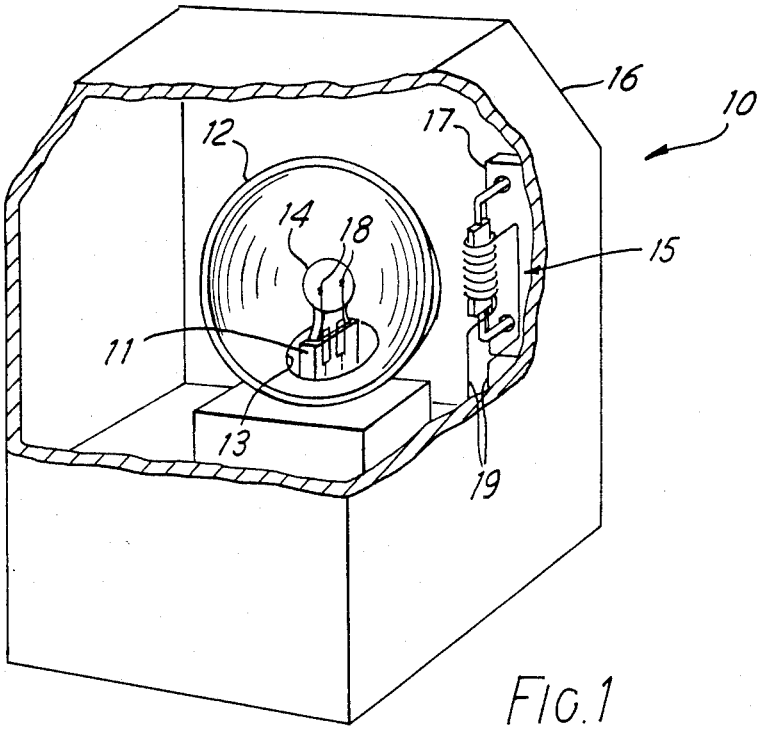

This invention relates to gas discharge lamps and more particularly to gas discharge lamps of the single ended type.

In a gas discharge lamp a pair of spaced electrodes, typically of tungsten are mounted within a sealed transparent or transulcent envelope filled with a gas or a vapour which emits light when a discharge takes place between the electrodes. The electrodes are, in general, each mounted on an electrically conductive lead which extends through the envelope. In some lamps, each lead includes a foil section typically of molydenum, which is sealed in a flattened portion of the envelope to form a pinch seal.

Discharge lamps of this kind may have a double-ended construction wherein the electrodes are mounted to lead pins supported by separate pinch seals located at opposite ends of the cylindrical envelope. An alternative form of discharge lamps is a single ended construction wherein the electrodes are supported in side-by-side relationship, by a common pinch seal located at one end only of a generally spherical envelope. A known form of single-ended discharge lamp is the "compact source iodide" (CSI) lamp (See, for example "Lamps and Lighting", Ed. Henderson & Marsden 2nd Ed. pp 274–276) in which the discharge takes place between electrodes spaced from 5 to 20 mm apart, and such a compact lamp arrangement proves to be particularly convenient for use in a mirror, lens or reflector optical system. CSI lamps generally contain a mixture comprising metal halides, mercury and inert gas, for example, argon and in an extension of the development of CSI lamps commonly referred to as the "compact iodide daylight" (CID) lamp, the composition and pressure of the gas fill is adjusted to yield an emission spectrum more closely resembling that of natural daylight. CID lamps usually contain tin and/or indium halides together with mercury and argon gas. Other metals such as scandium may be used.

According to a first aspect of the present invention there is provided a projector lamp comprising: a metal halide discharge arc tube, the arc tube comprising an envelope portion and a seal portion, two electrodes extending into said envelope portion and being spaced apart therein to define an arc discharge path therebetween, the arc discharge path having a longitudinal axis; and means for applying a magnetic field to the envelope to regularise the flow of convection currents around a stable arc independently of the effect on said arc path, when the lamp is running.

According to a further aspect of the present invention there is provided a projector lamp comprising a metal halide short arc discharge tube disposed within a reflector, the arc tube comprising an envelope portion and a seal portion, two electrodes extending into the envelope and being spaced apart therein in side by side relationship to define, in use, an arc discharge path therebetween having a longitudinal axis, lead in members for respective electrodes hermetically sealed within the seal portion and means positioned outside the reflector for applying a magnetic field having a major component substantially at right angles to the longitudinal axis of the discharge path to regularise the flow of convection currents around a substantially stable arc during running of the lamp.

In a known form of double ended linear lamp, for example, disclosed in U.S. Pat. No. 4,001,626 a double ended tin halide discharge lamp is disclosed which suffers from arc instability at high halide concentrations. The instability if found to disappear when the lamp is placed in a horizontal operating position, that is, with the axis of the discharge in a horizontal plane. However, in the horizontal position, the discharge arc has a strong upwards bow. To cure this and centre the arc in the axis of the discharge tube a weak magnetic field is applied axially along the length of the arc. United Kingdom patient specification No. 951,854 discloses another example where a magnetic field is applied to influence the arc shape, in this case to urge the arc downwards towards the surface of the arc tube. In both the above cases, therefore, the magnetic field is applied to influence the shape of the discharge arc.

Figure 6:
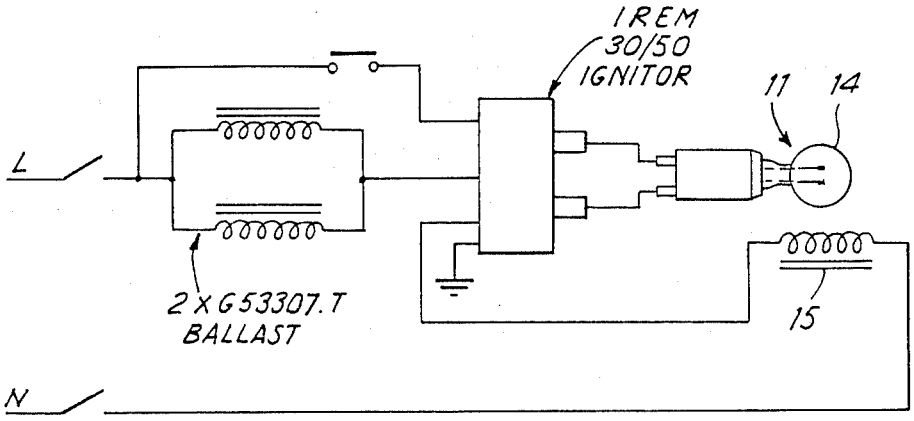

With both double ended and single ended lamps, especially "hot re-strike" lamps, it is known that relatively high voltages are required to start the lamps and therefore use is made of starting aids in the form of conductive loops, or part loops, encircling the lamp envelope so that they also encircle the electrodes, or some part of the envelope adjacent the electrodes such as the pinch seal. An example of a short arc high intensity double ended discharge lamp used in photographic projectors and incorporating a loop starting aid is disclosed in U.S. Pat. No. 4,053,809. In the embodiment of FIG. 6 there is disclosed a double ended discharge arc tube disposed within a reflector wherein the starting loop is arranged around a sealing stem so that it is capacitively coupled in the area of an electrode. The starting aid is attached to a conductor carrying lamp current to the free end of the arc tube and the conductor forms a partial loop around the arc tube. It is believed the effect of any magnetic field generated by current flowing in this single conductor would simply be a tendency to bow the discharge arc as described above. It is notable this patent draws a distinction between short arc lamps, which category includes the discharge arc tube of the present invention, and fluorescent lamps.

In the operation of some metal halide discharge arc tubes for use in projector lamps we have found that in operation, as opposed to starting, some arc tubes exhibit a turbulent swirling movement of gas fill around the discharge arc which is believed to be due to convection currents, and which occur even though the discharge arc is stable. This results in a fluctuation of light output and when used in conjunction with a reflector to concentrate the light such as in a projector lamp for studio or theatre applications the apparent movement of the projected light is extremely disturbing to the eye and undesirable. This phenomenon has to be distinguished from movement of the discharge arc due to unstable running as disclosed in the aforementioned U.S. Pat. No. 4,001,621. In some lamps, for example 1 Kw, the phenomenon of turbulence can be produced by running the lamp at a power greater, say, than 40% in excess of running power which is a useful method of testing. Since the lamp is not over powered in normal operation the probem does not arise. We have now found, however, that the same problem arises with arc tubes of greater power, for example, 2.5 Kw even when run at normal power. We have now found the turbulent movement can be regularised or made laminar so that the undeirable effect becomes undetectable by the eye although some such movement may still be present. We can achieve this by applying a magnetic field having at least a component at right angles to the discharge path and it is hypothesised that the effect of the magnetic field is somehow to orient, the particles so that they move in a more regular manner. It has been found that the turbulent flow is extremely sensitive to small changes. Even acceptable manufacturing tolerances in arc tube manufacture can affect the extent of the turbulence. Hence it is preferable to have provision for varying the magnetic effect in any one arc tube arrangement which may be done by varying the position of the magnet or the designed strength of the magnet. In this way the magnetic effect on the arc tube may be "tuned" for any particular arrangement until the undesirable effect is removed.

Figure 2:
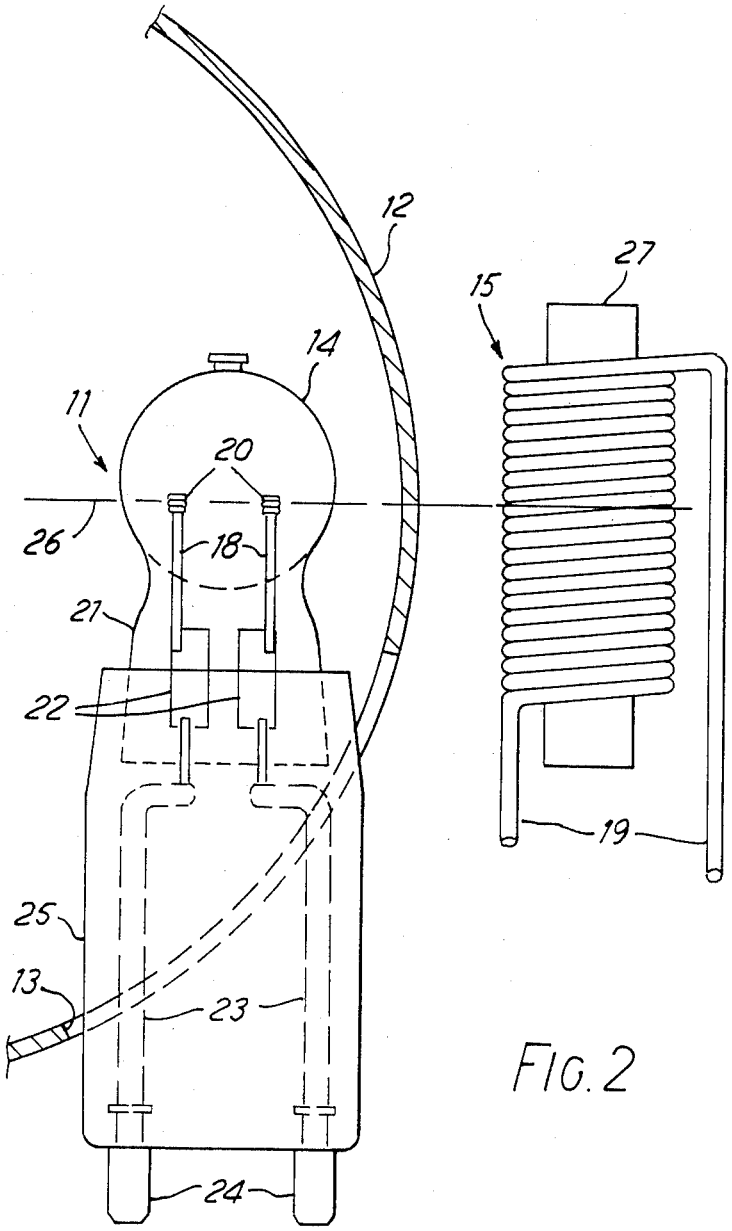
Figure 3:
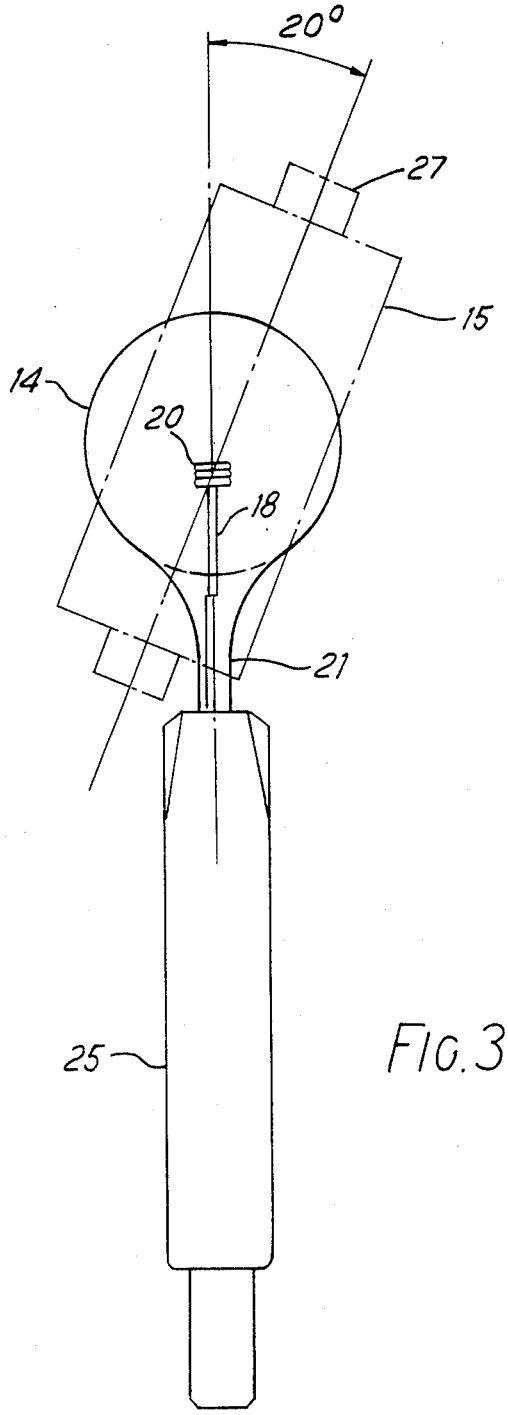
Figure 5:
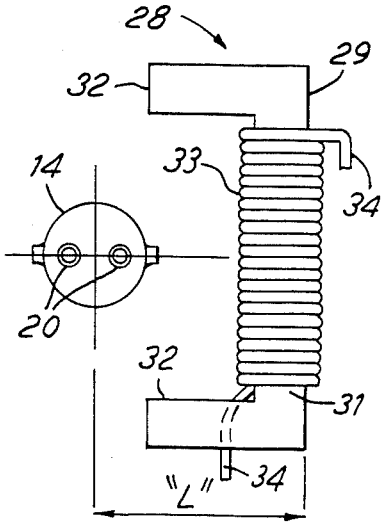
Figure 4:
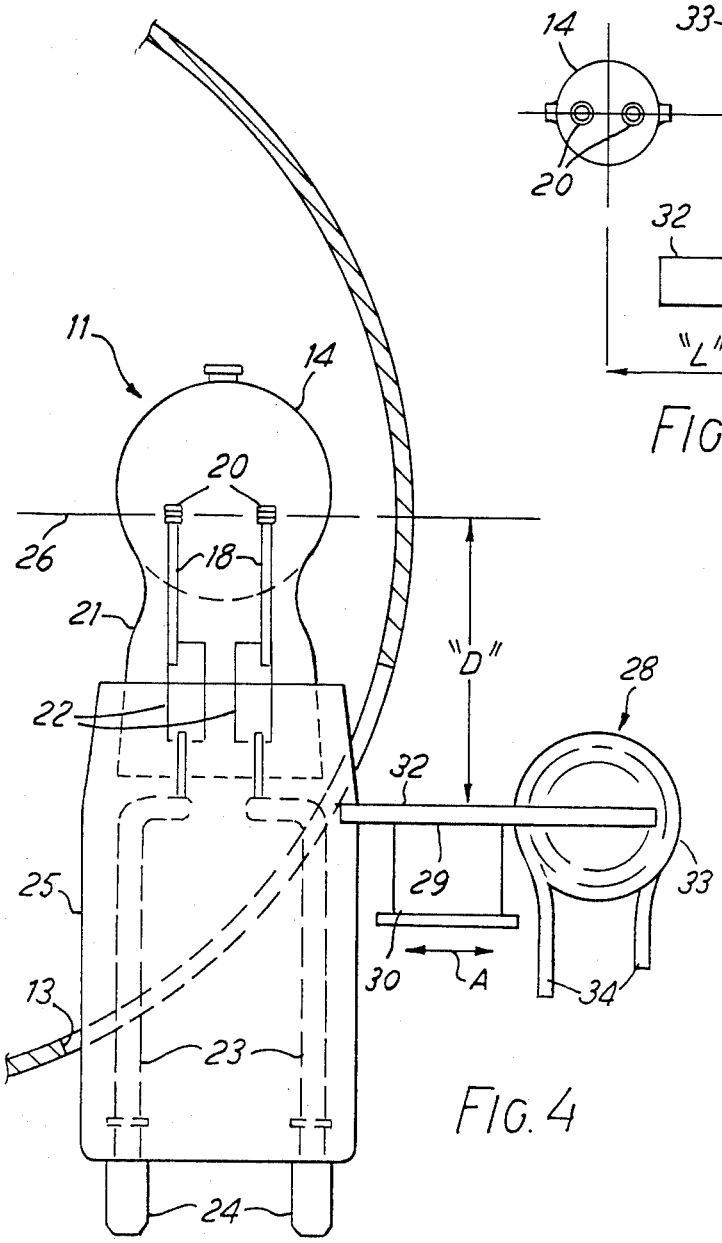

The invention will now be described way way of example only and with reference to the undernoted drawings wherein:

FIG. 1 is a part perspective view of a projector lamp in accordance with the invention, FIG. 2 is a part sectional view of one embodiment of the invention, FIG. 3 is an end view of the arrangement of FIG. 2, FIG. 4 is a part sectional view of another embodiment of the invention, FIG. 5 is a part plan view of the arrangement of FIG. 4, and FIG. 6 is a diagram of the electrical circuit used in the invention.

In FIG. 1, reference numeral 10 denotes generally a 2,500 W projector lamp in accordance with the present invention. This comprises a 2,500 W tin halide discharge arc tube 11 located centrally within an aluminium reflector 12. The reflector 12 has an opening 13 through which the discharge arc tube envelope 14 protrudes so that it can be aligned on the reflector axis 26. An electro magnet in the form of a coil 15 is located behind the aluminium reflector 12. The assembly of the tin halide discharge arc tube 11, aluminium reflector 12 and electro magnetic coil 15 is conveniently located within a projector lamp housing 18. The electro magnet coil 15 is located on a rotatable mount 17 so that its position can be varied with respect to the vertical axis of the in-line discharge electrodes 18 and is energised with lamp current by means of leads 19. Mount 17 is also slidable to and fro.

FIG. 2 shows a section of the projector lamp of FIG. 1 to greater detail. The discharge arc tube 11 comprises a generally rounded envelope 14, thus providing an aspect ratio of one which is typical of the aspect ratio of the aforementioned short arc discharge tube. In this example the envelope 14 is of quartz material with pinch seal 21 at one end only and has a diameter of approximately 40 mm. Mounted in hermetically sealed side-by-side relationship in pinch seal 21 to intrude into the envelope 14 is a pair of overwound tungsten electrodes 18 spaced apart approximately 20 mm constituting a short arc discharge tube. These are connected within the pinch seal 21 to molydenum foils 22 which in turn are attached to electrical connectors 23 and thereby to terminal pins 24. The arc tube 11 is fitted within a ceramic cap 25 by means of suitable cement. The discharge arc tube protrudes through an opening 13 in a part spherical aluminium reflector 12 and is aligned such that the centre of the electrode tips 20 is substantially on longitudinal axis 6 co-axial with the focus of the reflector 12 and being the discharge axis. Mounted behind the reflector 12 at one end of axis 26 is electro-magnet 15, also centred on the electrode tips 20 and axis 26. The electro-magnet comprises 25 turns of 30 amp capacity cable 19 around a rectangular core 27 comprising 10 laminations of a transformer metal, usually silicon steel, each $3.75\times0.75\times0.020$ inches. Leads 19 are connected such that they can be energised by the lamp current as shown in FIG. 6. The electro magnet will have the desired effect when operated at a distance of 1.5 inches from the lamp envelope 14 up to about a distance 2.25 inches away from the lamp envelope 14. It could be placed closer to the arc tube but the reflector 12 intervenes. Placement within the reflector would reduce the light output. The electro-magnet may be operated with its main axis vertical and in line with the vertically in-line electrodes 18 or it may be aligned at an angle of $+20°$ from the vertical as shown in FIG. 3. The electro-magnet 28 is mounted on support 30 which can move to and fro relative to the arc tube 11 as shown by the double headed arrow A so that the magnetic effect on the arc tube 11 may be varied. In FIG. 3 the outline of the electro-magnet is shown in chain dot for ease of description. The symmetrical arrangement of the magnet 27 with respect to discharge arc axis 26 shown in FIG. 2 will result in the magnetic field being substantially wholly at right angles to the discharge arc axis 26.

In FIG. 4 there is shown another embodiment of the invention, however since the same 2,500 W tin halide arc discharge tube is used the same reference numerals are used in the description. In this embodiment the electro-magnet 28 comprises a square C shaped core 29 having a long central limb 31 and shorter arms 32. The coil 33, in this case, comprises 30 turns of 30 amp cable energised by lamp current by leads 34. The core 20 is made up of $25\times2.5\times0.75$ inch C-shaped laminations giving an overall thickness of 0.138 inches. In FIG. 4 the arrangement of the electromagnet 28 is off the longitudinal axis 26 and will result in a reduced magnetic effect but it was still found the magnetic field regularised the turbulent flow.

Over this range different convection effects which may arise due to slight differences in lamp construction may be accommodated.

In this case it was found the positioning of the electro-magnet was more critical than with the embodiment of FIGS. 2 and 3. In FIG. 4, for example, it was found the vertical dimension "D" could be up to 2.25 inches $\mp0.25$ inches and in FIG. 5 the horizontal dimension "L" could be up to 3.375 inches $\mp0.125$ inches.

FIG. 5 shows the electrical circuit for controlling the turbulence in a 2,500 W CID lamp as described above.

It is emphasised that in the configuration shown in FIG. 2, should the magnetic field affect the arc, the arc would tend to be deflected sideways out of the plane of the paper depending on the direction of lamp current flowing in coil 15. In FIG. 4, on the other hand, should the magnetic field affect the arc, the arc would be expected to move upwardly or downwardly depending on the direction of current flowing in coil 33. In the practice of the invention, however, we have found the turbulent flow has been regularised independent of the effect of the magnetic field on the arc path. Indeed, the effect on the arc appeared to be minimal and certainly does not affect the stability of the arc.

I claim:

1. A projector lamp comprising a metal halide discharge arc tube including an envelope having a seal portion, two electrodes extending into said envelope and being spaced apart from one another, in side-by-side relationship, to define an arc discharge path therebetween, and means for applying a magnetic field within the envelope, the magnetic field being effective, in use of the lamp, to regularise a convective flow of gases relative to the discharge arc and having no substantial effect on the arc path when the lamp is running.

2. A projector lamp comprising a reflector, a metal halide discharge arc tube disposed within a reflector, the arc tube comprising an envelope having a seal portion, two electrodes extending into the envelope and being spaced apart from one another, in side-by-side relationship, to define an arc discharge path therebetween and means for applying a magnetic field within the envelope, the magnetic field being effective, in use of the lamp, to regularise a convective flow of gases relative to the discharge arc and having no substantial effect on the arc path when the lamp is running.

3. A projector lamp according to claim 2 having a magnet assembly disposed off the longitudinal axis.

4. A projector lamp according to claim 2 having a magnet assembly fed by lamp current.

5. A projector lamp according to claim 2 having a magnet assembly moveable relatie to the arc tube envelope.

6. A projector lamp according to claim 5 wherein the magnet assembly is moveable linearly with respect to the arc tube envelope.

7. A projector lamp according to claim 5 wherein the magnet assembly is moveable angularly with respect to the arc tube envelope.

8. A projector lamp according to claim 2 wherein the arc tube envelope has an aspect ratio of one.

9. A projector lamp according to claim 8 having a generally rounded envelope.

10. A projector lamp according to claim 2 wherein said magnetic field applying means is arranged symmetrically with respect to a longitudinal axis extending through said electrodes, whereby said magnetic field is applied substantially at right angles to said axis.

* * * * *